United States Patent [19]

Shomer

[11] Patent Number: 4,708,349

[45] Date of Patent: Nov. 24, 1987

[54] CHESS FOR PLAY BY TWO, THREE OR FOUR PERSONS

[76] Inventor: Dan Shomer, Lake Pillsbury Ranch, Potter Valley, Calif. 95469

[21] Appl. No.: 792,362

[22] Filed: Oct. 29, 1985

[51] Int. Cl.[4] ..... A63F 3/02

[52] U.S. Cl. ..... 273/261

[58] Field of Search ..... 273/260-262

[56] References Cited

U.S. PATENT DOCUMENTS

| | | | |
|---|---|---|---|
| 711,959 | 10/1902 | Graham . | |
| 1,555,937 | 10/1925 | Billman . | |
| 2,045,339 | 6/1936 | Boland | 273/131 |
| 2,614,842 | 10/1952 | Rice | 273/261 |
| 3,843,130 | 10/1974 | Whitney, Jr. | 273/131 |
| 4,147,360 | 4/1979 | Bailey | 273/261 |
| 4,190,254 | 2/1980 | Leeds | 273/261 |

FOREIGN PATENT DOCUMENTS

| | | |
|---|---|---|
| 873035 | 6/1942 | France . |
| 1165694 | 10/1958 | France . |
| 489702 | 1/1954 | Italy . |
| 1030519 | 5/1966 | United Kingdom . |

*Primary Examiner*—Richard C. Pinkham
*Assistant Examiner*—MaryAnn Stoll Lastova
*Attorney, Agent, or Firm*—Townsend and Townsend

[57] ABSTRACT

A chess game is provided for play by two, three or four persons played according to the conventional rules of chess as to movement and capturing of pieces, castling, check and checkmate. As in conventional chess, each player possesses an initial force of a king, a queen, two bishops, two knights, two rooks and eight pawns. The game is played on a checkerboard having two hundred eight playing squares arranged in a central playing array of twelve bilaterally arranged rows having twelve squares per row and bordered by four smaller staging arrays, each of the staging arrays having eight bilaterally arranged rows of two squares per row. One of each of the four staging arrays is longitudinally centered on and contiguous with each of the four sides of the central playing array. Two of the four staging arrays have squares of different colors from each other. The players may play as individuals, or they may play as partners, including two playing as partners against a third or four playing as two sets of partners against one another.

2 Claims, 2 Drawing Figures

CHESS FOR PLAY BY TWO, THREE OR FOUR PERSONS

BACKGROUND OF THE INVENTION

1. Field of the Invention

This invention relates generally to board games and more specifically to an improved chess game for play by two, three or four persons. The rules of chess as to movement and capturing of pieces, castling, check and checkmate all apply. The players may play as individuals, or they may play as partners, including two playing as partners against a third or four playing as two sets of partners against one another.

Board games have been known for centuries, examples of which include go, backgammon, checkers and chess. These games are played by two players and involve considerable strategy. Chess and checkers are played on a conventional square checkerboard having sixty-four square playing spaces in eight rows of eight squares each. In chess, each of the two players possess an initial force of a king, a queen, two bishops, two knights, two rooks, and eight pawns. The object of chess is to place the opponent's king in checkmate.

2. Description of the Relevant Literature

A number of inventors have designed board games for play by more than two persons. These games all employ a checkered board and can be divided into two broad categories, checker-type games and chess-type games. For the most part, prior art games have accommodated additional players by altering the shape of the conventional sixty-four square checkerboard and/or by adding playing squares. For example, U.S. Pat. Nos. 1,555,937 and 2,045,339, French Pat. No. 873,035, and Italian Pat. No. 489,702 all disclose checker-type games for play by up to four players wherein the shape of the board and the number of squares are significantly altered.

Examples of four person chess-type games may be found in U.S. Pat. Nos. 3,843,130, 4,147,360 and 4,190,254 as well as British Pat. No. 1,030,519 and French Pat. No. 1,165,694. Whitney (U.S. Pat. No. 3,843,130) alters the size of the conventional chessboard and adds two royalty pieces to each player's set of playing pieces. Also, due to the arrangement of additional playing squares, opposing queens and kings are initially placed in opposite rows, unlike conventional chess. Bailey (U.S. Pat. No. 4,147,360) also increases the number of playing pieces and playing squares. Leeds (U.S. Pat. No. 4,190,254) increases the number of playing squares and curves the paths of movement of the playing pieces. Toft (British Pat. No. 1,030,519) increases the number of playing squares and alters the direction of movement of the pawns. Guerz (French Pat. No. 1,165,694) increases the number of playing squares, however, a problem associated with Guerz, as well as Whitney, is that a player may find that the initial movement of one of the two pawns closest the player by an opponent on either side either blocks the player's initial movement of his lateral pawns or places them, upon movement, behind the opponent's. This removes some opening moves from players following the opening player and places players familiar with conventional chess in unfamiliar situations.

For example, Whitney, places four sets of chess pieces around a conventional chessboard such that pawns may not be moved initially without ending up behind a pawn previously moved by an opponent, altering the strategy of play significantly. Features of several other prior art devices also inherently change the strategy of play. For example, Leeds places the pieces on curved paths, which impair the visualization of future movement of the pieces by persons familiar with standard chess play; Bailey also adds additional pieces, changing the strategy of play; and Toft alters the movement of pawns to avoid the problems of pawn movement associated with Whitney.

Since prior art four-person chess games significantly alter the strategy of play, it would be desirable to provide a four-person chess game such that conventional chess strategy is substantially retained.

SUMMARY OF THE INVENTION

A chess game is provided for play by two, three or four persons played according to the conventional rules of chess as to movement and capturing of pieces, castling, check and checkmate. As in conventional chess, each player possesses an initial force of a king, a queen, two bishops, two knights, two rooks and eight pawns. The game is played on a checkerboard having two hundred eight playing squares arranged in a central playing array of twelve bilaterally arranged rows having twelve squares per row and bordered by four smaller staging arrays, each of the staging arrays having eight bilaterally arranged rows of two squares per row. One of each of the four staging arrays longitudinally centered on and contiguous with each of the four sides of the central playing array. The players may play as individuals, or they may play as partners, including two playing as partners against a third or four playing as two sets of partners against one another.

The present invention is an improvement over prior art devices in that persons skilled in conventional chess will find that conventional chess strategy applies to the subject device. This is accomplished by providing a playing surface adapted for play by two, three or four persons while retaining the basic components of conventional chess. The conventional rules of chess as to movement and capturing of pieces, castling, check and checkmate apply. Each player begins play with the familiar set of chess pieces; eight pawns, two rooks, two knights, two bishops, one queen, and one king. Also, the initial placement of the chess pieces on the playing board is according to conventional play; that is, opposing kings and queens are found in the same row.

While conventional chess strategy is applicable to the present invention, the game is enhanced by the additional dimension of a player finding himself in jeopardy by more than one opponent. Also, due to the design of the game board, each player is free to make opening moves with his lateral pawns without finding himself either blocked by or moving behind an opponent's pawns.

The exchange of pawns for captured pieces is facilitated in the preferred embodiment of the subject invention by providing each player with a keep, wherein pieces captured by a player are placed for display to the other players.

DESCRIPTION OF THE PREFERRED EMBODIMENTS

I. Game Apparatus

The apparatus of the invention, as generally described above, comprises a game board and four sets of playing pieces, each set being distinguishable one from another and having eight pawns, two rooks, two knights, two bishops, one queen and one king.

Figure 1:
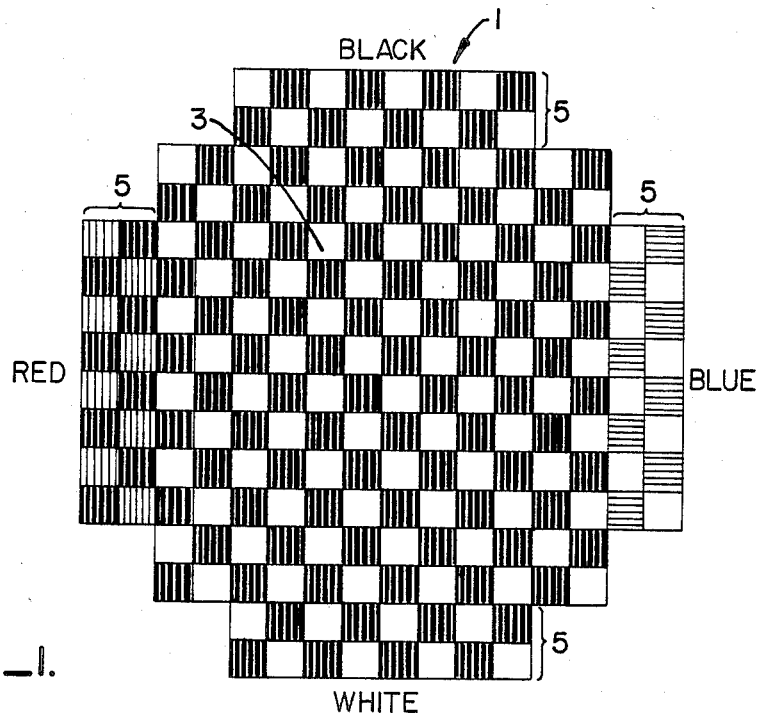
FIG. 1 is a top view of the checkerboard playing surface.

Referring to FIG. 1, the game board 1 of the preferred embodiment is depicted having two hundred eight playing squares arranged in a central playing array 3 of twelve bilaterally arranged rows of twelve squares per row. Central playing array 3 is bordered by four smaller staging arrays 5, each of the staging arrays having eight bilaterally arranged rows of two squares per row. One of each of arrays 5 is longitudinally centered on and contiguous with each of the four sides of central playing array 3.

Figure 2:
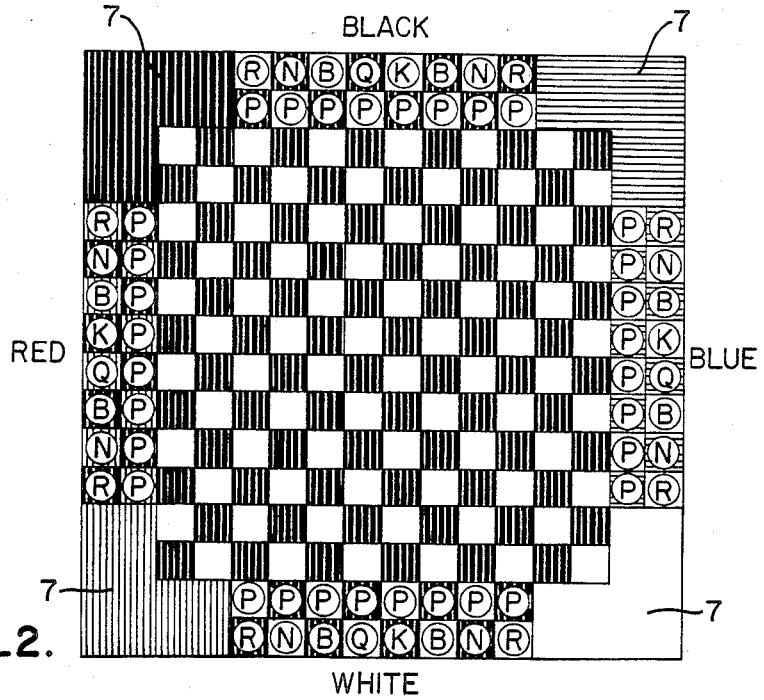
FIG. 2 is a top view of the checkerboard playing surface showing the playing pieces in their initial position and the keep areas.

The squares of central playing array 3 are alternating black and white in coloration. The checkerboard pattern is carried on into contiguous staging arrays 5 except that one of the two colors in each of arrays 5 is the same as the color of the playing pieces placed on that array at the start of play, as depicted in FIG. 2. For example, in the preferred embodiment, two of the staging arrays 5 are black and white in coloration, the third is black and red in coloration and the fourth is blue and white in coloration.

As described previously, in the preferred embodiment the individual pieces of each set of playing pieces are distinguished from those of an opponent's by coloration. The four sets of playing pieces employed in the preferred embodiment are colored black, white, red and blue.

Play is enhanced in the preferred embodiment by providing each player with a keep 7 for the placement of captured pieces. In the preferred embodiment, keep 7 is located to the right of each player and colored the same as each players' playing pieces.

II. Rules of Play

The rules of play of the preferred embodiment of the present invention are those of conventional chess with respect to movement and capturing of pieces, castling, check and checkmate except for the following modifications:

(a) The order of play is the opening player, the player directly opposite the opening player, the player to the left of the opening play and finally the player to the right of the opening player;

(b) During individual play, any player may be placed check or checkmate by any of the other players individually or in combination;

(c) During individual play, when a player is placed in checkmate, the player's pieces are removed from the board and play continues until only one player remains or a stalemate results;

(d) During partnership play, one or both partners may place either or both the opposing players in check or checkmate;

(e) During partnership play, when one player of a team is placed in checkmate, the player in checkmate removes his pieces from the playing area and play continues until both partners of the team have been checkmated;

(f) Pawns may be exchanged for captured pieces than pawns by moving a pawn to the opposite end of the playing board from which the pawn began play, and the pawn may then be exchanged for any piece captured by any player or either player of a team; and (g) When a player captures an opponent's piece, the captured piece is placed in the keep of the capturing player.

While the staging arrays, sets of playing pieces and keeps are distinguished one from another by coloration in the preferred embodiment, it will be obvious to one skilled in the art that such distinction may be obtained in a variety of other ways. The black, white, red and blue coloration of the preferred embodiment is offered by way of illustration and not limitation.

The foregoing rules and description of preferred embodiments are provided for illustration. The true scope of the invention is defined by the following claims.

What is claimed is:

1. A chess game for play by two, three, or four persons comprising:

a checkerboard having one hundred and forty-four squares arranged in a central playing array, said central playing array having twelve bilaterally arranged rows of twelve squares per row;

an additional peripheral playing area further comprising four staging arrays, each of said staging arrays having eight bilaterally arranged rows of two squares per row, one of each of said staging arrays being longitudinally centered on and contiguous with one of each of the four sides of said central playing array and wherein said staging arrays include a staging array having squares of two different colors both of which colors are different from those of a second staging array; and four sets of playing pieces, said sets being distinguishable one from another and comprising the following pieces per set:

Eight pawns;
Two rooks;
Two knights;
Two bishops;
One queen; and
One king.

2. A chess game according to claim 1, further comprising a keep adjacent each player for the placement of captured pieces, said keep being identical in color to said player's pieces.

* * * * *